US005413037A

United States Patent [19]

Auslander et al.

[11] Patent Number: 5,413,037

[45] Date of Patent: May 9, 1995

[54] USE OF ENCAPSULATED INK FOR ENHANCING POSTAGE METER SECURITY

[75] Inventors: Judith D. Auslander, Westport; William Berson, Weston, both of Conn.

[73] Assignee: Pitney Bowes Inc., Stamford, Conn.

[21] Appl. No.: 262,430

[22] Filed: Jun. 20, 1994

[51] Int. Cl.[6] ..... B41F 19/02

[52] U.S. Cl. ..... 101/9; 101/16; 101/27; 101/32

[58] Field of Search ..... 101/91, 9, 16, 21, 27, 101/31, 32

[56] References Cited

U.S. PATENT DOCUMENTS

| | | | |
|---|---|---|---|
| 3,928,226 | 12/1975 | McDonough et al. | 252/301.2 R |
| 4,016,099 | 4/1977 | Wellman et al. | 252/316 |
| 4,641,346 | 2/1987 | Clark et al. | 101/71 |
| 4,649,266 | 3/1987 | Eckert | 235/432 |
| 4,920,361 | 4/1990 | Arahara et al. | 101/450.1 |
| 4,933,849 | 6/1990 | Connell et al. | 364/400 |
| 5,114,478 | 5/1992 | Auslander et al. | 106/20 |

*Primary Examiner*—Ren Yan
*Attorney, Agent, or Firm*—Ronald Reichman; Melvin J. Scolnick

[57] ABSTRACT

Apparatus and method for enhancing the security of mechanical postage meters through use of an encapsulated fluorescence quenching substance. An encapsulated quenching substance is blended with red fluorescent inks that are used to print postage indicia. The fluorescent quenching substance that is encapsulated has the characteristic of reacting with the fluorescent dye in the ink to cause a bathochromic shift of the wave length where reflectance occurs. By designing the printhead of the postage meter in an appropriate way, a portion of the encapsulated substance can be ruptured during printing of the postage indicia, thereby providing an area where the bathochromic shift has occurred. Thereafter, the indicia can be exposed to ultraviolet light and a determination can be made whether the postage indicia has been printed by a postage meter by inspecting the portion of the indicia where a bathochromic shift is expected.

13 Claims, 2 Drawing Sheets

USE OF ENCAPSULATED INK FOR ENHANCING POSTAGE METER SECURITY

BACKGROUND OF THE INVENTION

Throughout the existence of the postage meter, consistent efforts have been made to render the postage meters secure, and prevent the unauthorized printing of postage. By unauthorized printing of postage is meant the printing of a postage indicia on a mail piece without the sender of the mail accounting for the postage. Throughout the years, postage meters have generally used physical security, such as secure housings and non accessible connections. Despite such physical security, conventional postage meter imprints are subject to counterfeiting through the use of readily available fluorescent postage meter inks with rubber stamps or other printing dies. In addition, various digital printers, such as bubble jet printers and drop on demand ink jet printers, can be used to create an authentic appearing, fraudulent postage meter imprint.

It would be advantageous, and substantially reduce the opportunity of fraudulent postage indicia printing, to have a scheme whereby physical characteristics are imparted to the postage indicia that provide an indication of a genuine postage meter impression. In addition, it would be advantageous if such a scheme had the advantage of occurring at the time of printing of the genuine postage imprint without the possibility of an alteration thereafter.

SUMMARY OF THE INVENTION

A scheme has been devised whereby postage meter imprints are rendered difficult to counterfeit. This is accomplished by use of a fluorescent quenching substance that will react with a portion of the fluorescent ink, such as red fluorescent, that prints the postage meter impression during the printing of the same. This is accomplished by the use of encapsulated fluorescent quenching dyes that are blended with the red fluorescent ink. A portion of the encapsulated materials are ruptured during the printing of the postage meter impression at a designated location of the postage indicia. As a consequence, the postage indicia will have a fluorescent peak at two locations. The first location is that of the unquenched fluorescent ink and the second location is that of the quenched fluorescent ink. The encapsulated materials can be ruptured either physically or through the application of heat or vibration.

BRIEF DESCRIPTION OF THE DRAWING

In the following figures, the same reference numbers are used to indicate like parts.

DETAILED DESCRIPTION OF THE PREFERRED EMBODIMENT

Figure 1:
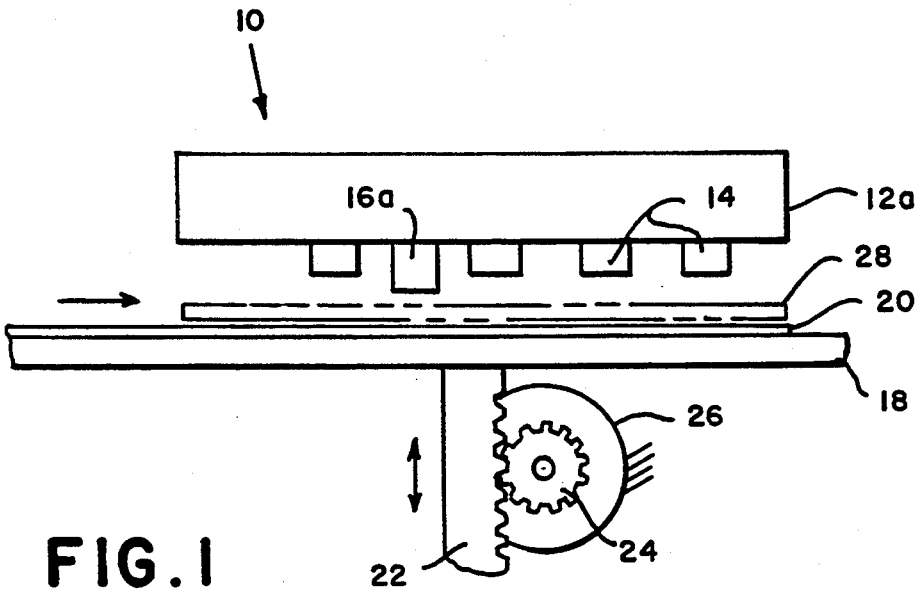
FIG. 1 is a cross sectional view of the printing portion of a postage meter that embodies the principals of this invention.

With reference now to FIG. 1, the printing station of a postage meter is shown generally at 10, and includes a printhead 12*a* having rows of print dies 14 extending therefrom. A selected portion of the print dies 16*a* extend from the printhead 12*a* with a somewhat greater length than the other print dies 14. The printhead 12*a* is attached to the postage meter by conventional means (not shown).

Spaced relative to and facing the printhead 12*a* is a platen 18 which is shown supporting a mail piece 20 thereon. The platen 18 is supported by a rack 22 whose teeth engage the teeth of a pinion 24. The pinion 24 is mounted on the output shaft of a stepper motor 26 for rotation therewith to impart reciprocal motion to the rack 22 as indicated by the arrow. An ink pad 28 is operative to be driven into contact with the dies 14, 16*a* by means (not shown) to transfer ink to the dies. Although the invention is described with use of an ink pad, it will be appreciated that ink rollers can be used equally as well. Mechanisms for accomplishing the movement of the ink pad 28 are well known, see for example U.S. Pat. No. 5,269,220. The pad 28 will have a fluorescent ink, preferably red fluorescent ink, blended with an encapsulated fluorescent quenching material. Fluorescent inks used in postage meters are well known, see, for example U.S. Pat. Nos. 3,928,226; 4,014,131 and 5,114,478. The techniques used to encapsulate the fluorescent quenching material are known as microencapsulation. Encapsulation techniques are well known and have been used for decades in the production of carbonless paper. An example of a microencapsulation process involves using the combination of an emulsion of polymerized vinyl, monomers in an aqueous medium containing an emulsifier and a water soluble initiator. Reference can be had to U.S. Pat. Nos. 2,730,456, 3,788,994 and 4,016,099 for examples of different types of microencapsulation techniques.

An example of a dye that can be encapsulated is Acid Blue No. 9 which is soluble in water and can therefore be used in the aqueous solution. Other examples are phthalocyanine dyes with aromatic donor groups, CI Food Blue 2, CI Acid Blue 9 and CI Pigment Blue 24. The resins used to encapsulate the dyes have to match the triggering mechanism, i.e., rupture by the defined mechanical, thermal or vibration energy. Examples of resins that can be used are styrene divinyl benzene, polystyrene and polystyrene copolymers.

The printhead 12*a* will operate in a normal manner for printing a postage impression upon the mail piece 20. This is accomplished by the rack 22 moving reciprocally in order to bring about printing contact between the printhead 12*a* and the mail piece 20. Upon completion of such printing operation, the platen 18 will be lowered by the rack 22 and the ink pad 28 will be driven across the printhead 12*a* to deposit ink on the dies 14, 16*a* and then withdrawn.

Figure 2:
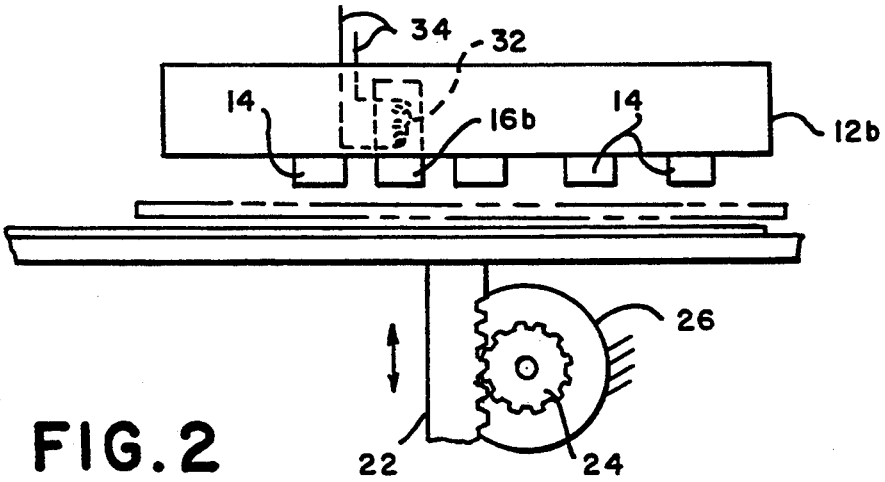
FIG. 2 is similar to FIG. 1, showing alternative embodiments.

FIG. 2 shows an alternative embodiment to that shown in FIG. 1. The dies 14 are all of the same height, but one of the dies 16*b* has a heating element 32 in connection therewith with a lead 34 extending therefrom and connected to a source of power, (not shown), for the purpose of applying power to the heating element. Alternatively the lead 34 can be connected to an ultrasonic vibration generating coil 32.

Figure 3:
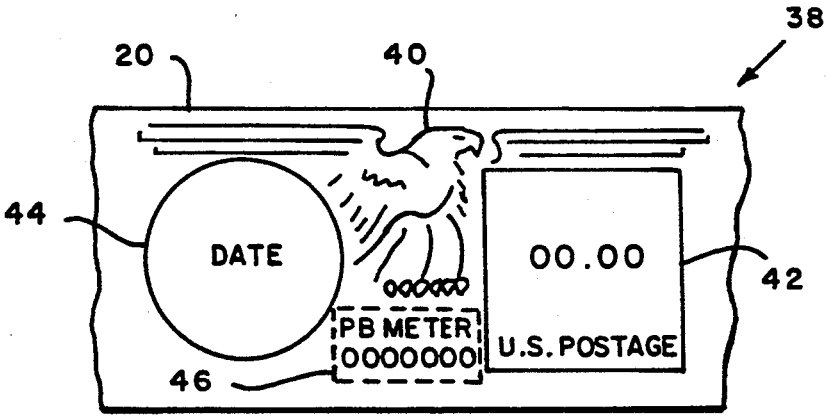
FIG. 3 is a postage meter impression printed in accordance with the instant invention.

With reference to FIG. 3, a postage indicia printed on a mail piece 20 is shown generally at 38 having a logo 40, a postage block 42, a date circle 44 and a postage meter number 46. This postage indicia 38 will have been printed either by the printhead 12*a* or 12*b*. The postage meter number is shown with a dotted frame 46 to indicate the postage meter number will emit a different wavelength when exposed to ultra-violet light as will be discussed hereinafter.

Figure 4:
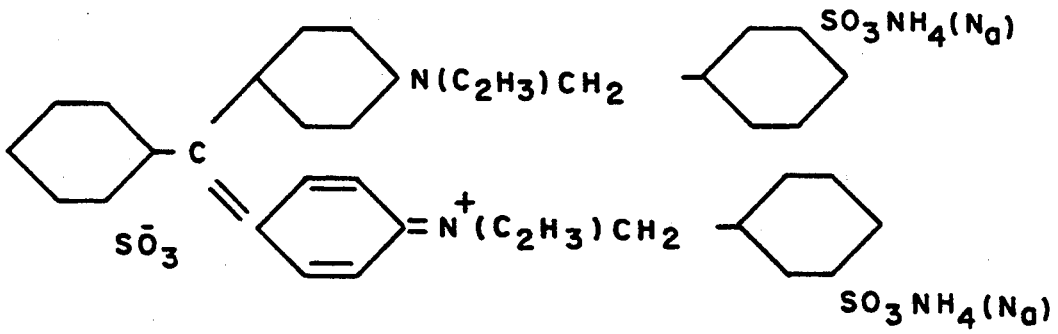
FIG. 4 is a chemical structure of a preferred reflectance quenching dye.

With reference to FIG. 4, a chemical structure is shown for a preferred fluorescent quenching dye. This fluorescent quenching dye will be encapsulated so as to be released when the capsule is ruptured. This fluorescent quenching dye will cause a bathomatic shift of the reflectance of the ink dye upon contact. For the purpose of this teaching, a spectral sensitive dye is defined as those dyes having a chemical structure that yields an absorption spectra that overlaps with the emission spectra of the primary dye and has a high extinction coefficient, $1\times10^2$ liters/mol cm and a narrow band width 50 nm.

In operation, a red fluorescent ink and encapsulated fluorescent quenching dye mixture is deposited on the dies 14, 16*a*, and the printhead 12*a* is moved into printing engagement with a mail piece 20 supported by the platen 18. The dies 14, 16*a* will be made of a material such as hard rubber, so that the encapsulated portion of the inks will not be ruptured by the dies 14. On the other hand, the die 16*a* exerts a greater pressure upon the ink because of its extended height. As a result of this greater pressure, the encapsulated substances will be ruptured and that portion of the printhead 12*a* that has raised dyes 16*a* will have the fluorescent quenching substance released. In the preferred embodiment of the invention, the postage meter number imprint 46 will be that portion that is printed by raised dies 16*a*. Because the encapsulated substance is ruptured, the fluorescent quenching dye mixes with the fluorescent ink. As a result, the postage meter number 46 portion of the indicia 38 will have a different reflectance than the other portions of the indicia due to the bathomatic shift. By inspecting the indicia through use of a source of ultraviolet light and spectrophotometer, one can look for the different peaks of reflectance to determine if a bathomatic shift has occurred. A genuine postage meter impression will have two such peaks, because of the quenching effect on a portion of the indicia; whereas, one that does not have the characteristics of rupturing the encapsulated fluorescent quenching substance will have a single peak. The imprint with only red fluorescent dye will not have a peak at the location where one would be present for a quenched fluorescence.

With reference to FIG. 2, once more the printhead 12*b* will have ink deposited thereon by application from the ink pad 28, but the die 16*b* will be heated to a higher temperature relative to the other dies 14. Because of this increased temperature, the encapsulating resin will be melted and the fluorescent quenching dye will be allowed to react with the fluorescent ink with the same results achieved in connection with FIG. 1. Alternatively, the die 16*b* could emit ultrasonic vibration that will cause the encapsulated materials to rupture.

With reference to FIG. 4, an example is shown of a chemical formula of a preferred fluorescent quenching dye that can be used in the instant invention. This compound is a condensed o-formybenzensulfonic acid with a-(N-ethylanilino)-m-toluensulfanic which has been oxidized with the product formed into ammonium sodium salt.

Figure 5:
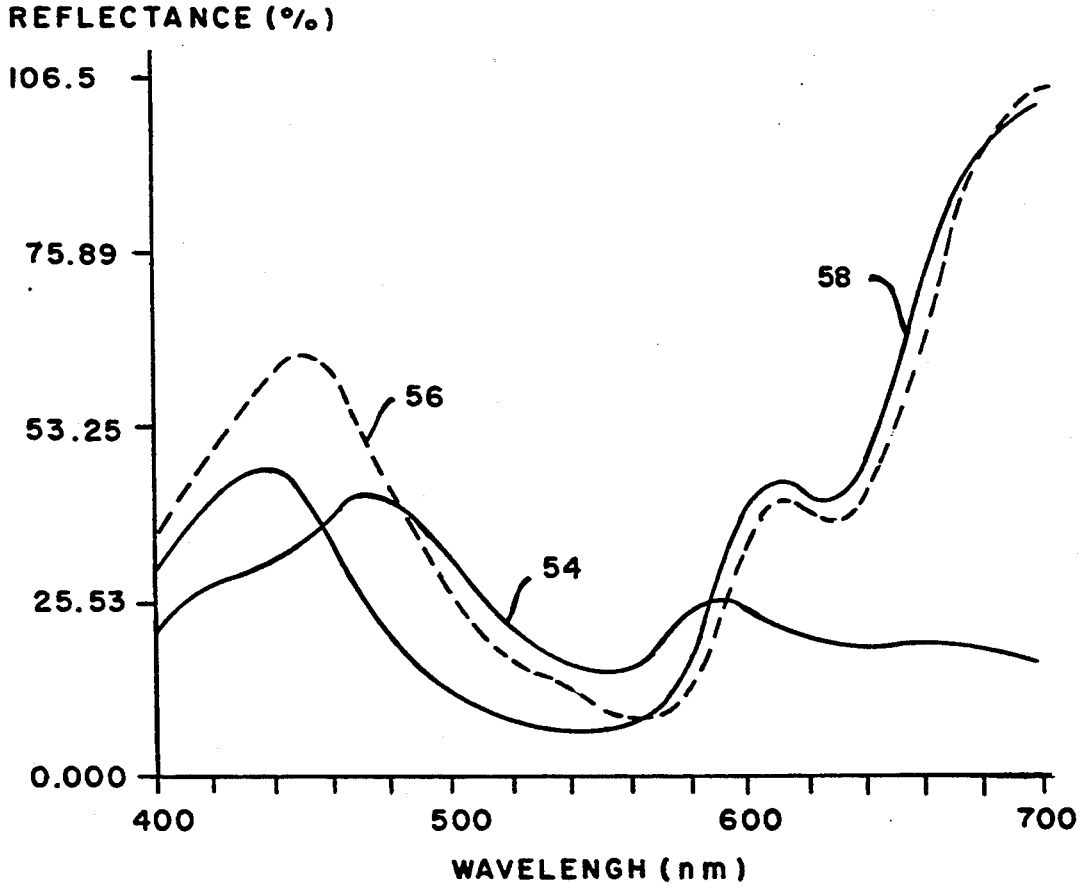
FIG. 5 is a graph illustrating the shift in spectral response and percent reflectance.

With reference to FIG. 5, a graph shows a red fluorescent ink plot 54, a fluorescent ink plot 56 that has been quenched with a spectral sensitive dye, such as CI acid Blue 9, and another plot 58 of a fluorescent ink that has been quenched with a second spectral sensitive dye, C.I. Pigment Blue 24. It will be noted that there is a first shift of the reflectance peak from approximately. 490 nm to 460 nm using one spectral sensitive dye and to 440 nm using the second spectral sensitive dye and also another shift from approximately 590 nm to approximately 700 nm using either of the spectral sensitive dyes. By exposing the logo 38 and the meter number block to ultra violet light, two different reflectances will be observed.

The advantage of the instant invention is that measures are taken at the time of indicia printing to provide a way of determining whether the printing of a meter impression is genuine. Once the printing occurs, the characteristics of the inks cannot be altered to allow one to be able to obtain shifts in the peaks of reflectance. This provides a convenient and easy method for the postal service to determine that the postage meter impression is genuine.

The above embodiment have been given by way of illustration only, and other embodiments of the instant invention will be apparent to those skilled in the art from consideration of the detailed description. Accordingly, limitations on the instant invention are to be found only in the claims.

What is claimed is:

1. In a postage meter printing station for printing a postage indicia that evidences the payment of postage, the combination comprising:

a print head, means for applying ink to said print head, said ink comprising a fluorescent dye and an encapsulated fluorescent quenching substance, said print head having means thereon for rupturing a portion of said encapsulated fluorescent quenching substance, a platen for supporting a mail piece, and means for driving said platen into printing engagement with said print head to cause said means for rupturing to rupture said portion of said encapsulated fluorescent quenching substance.

2. The postage meter printing station of claim 1, wherein said means for rupturing said portion of said capsulated fluorescent quenching substance is a raised die.

3. The postage meter printing station of claim 1 wherein said means for rupturing a portion of said encapsulated fluorescent quenching substance is a heated die.

4. The postage meter printing station of claim 1 wherein said means for rupturing a portion of said encapsulated fluorescent quenching substance is a die ultrasonically driven.

5. The postage meter printing station of any one of claims 1–4 wherein said fluorescent quenching substance is a spectral sensitive dye.

6. A method of printing a postage indicia so as to provide a way of detecting fraud the steps comprising:

providing a print head having print dies mounted thereon with a portion of said dies raised;

applying an ink having a fluorescent dye and an encapsulated fluorescent quenching substance to said print head, supporting a mail piece on a platen, and driving the platen into indicia printing engagement with the print head and rupturing the portion of the encapsulated fluorescent quenching substance that is contacted by said raised dies.

7. The method of claim 6 wherein the step of applying an encapsulated fluorescent quenching substance includes applying an encapsulated spectral sensitive dye.

8. The method of claim 6 further including the steps of exposing the printed indicia to ultraviolet light and determining if a bathomatic shift has occurred.

9. A method of printing a postage indicia so as to provide a way of detecting fraud the steps comprising:

applying an ink having a fluorescent dye and an encapsulated fluorescent quenching substance to a print head having a plurality of dies, supporting a mail piece on a platen, driving the platen into printing engagement with the print head, and heating at least one of the dies of the print head to a temperature that will cause a portion of the encapsulated fluorescent quenching substance to rupture.

10. The method of claim 9 wherein the step of applying an encapsulated fluorescent quenching substance includes applying an encapsulated spectral sensitive dye.

11. The method of claim 9 further including the steps of exposing the printed indicia to ultraviolet light and determining if a bathomatic shift has occurred.

12. A method of printing a postage indicia so as to provide way of detecting fraud the steps comprising:

applying an ink having a fluorescent dye and an encapsulated fluorescent quenching substance to a print head having a plurality of dies, supporting a mail piece on a platen, driving the platen into printing engagement with the print head, and providing ultrasonic motion to at least one of the dies of the print head for rupturing a portion of the encapsulated fluorescent quenching substance.

13. The method of claim 12 wherein the step of applying an encapsulated fluorescent quenching substance includes applying an encapsulated spectral sensitive dye.

* * * * *